US005560744A

United States Patent [19]

Schaffner III

[11] Patent Number: 5,560,744

[45] Date of Patent: Oct. 1, 1996

[54] BUFFING

[75] Inventor: Gus J. Schaffner III, Blawnox, Pa.

[73] Assignee: Schaffner Manufacturing Co., Inc., Pittsburgh, Pa.

[21] Appl. No.: 187,297

[22] Filed: Jan. 27, 1994

[51] Int. Cl.[6] ..... B24D 17/00

[52] U.S. Cl. ..... 451/490; 451/526

[58] Field of Search ..... 451/533, 490, 451/496, 497, 508

[56] References Cited

U.S. PATENT DOCUMENTS

| | | | |
|---|---|---|---|
| 1,106,833 | 8/1914 | Painter . | |
| 1,714,137 | 4/1928 | Radinse . | |
| 2,027,863 | 8/1935 | E. W. Hall . | |
| 2,106,610 | 1/1938 | Kreilick et al. . | |
| 2,109,905 | 3/1938 | Lippitt . | |
| 2,110,494 | 2/1937 | Zimmerman . | |
| 2,244,582 | 6/1941 | Thompson . | |
| 2,515,308 | 2/1946 | Lindham | 29/238 |
| 3,548,435 | 12/1970 | Comber et al. . | |
| 3,727,353 | 4/1973 | Pixley . | |
| 3,733,754 | 5/1973 | Jeske . | |
| 3,839,763 | 10/1974 | Gould . | |
| 3,991,526 | 11/1976 | Frank et al. . | |
| 3,991,527 | 11/1976 | Maran . | |
| 4,504,999 | 3/1985 | Pedrotte . | |
| 4,624,876 | 11/1986 | Nevin . | |
| 4,799,338 | 1/1989 | Schaffner | 451/508 |
| 4,850,158 | 7/1989 | Schaffner | 451/508 |
| 4,882,880 | 11/1989 | Schaffner, II et al. | 451/490 |

*Primary Examiner*—Bruce M. Kisliuk
*Assistant Examiner*—Andrew Geinberg
*Attorney, Agent, or Firm*—Hymen Diamond

[57] ABSTRACT

Buffing apparatus including a buffing assembly including a stack of buffing wheels with or without spacers between the rings, compressed under high pressure. Each wheel includes a clinch ring which in turn secures an annulus of fabric extending radially therefrom. Each spacer includes a ring; they may be the remnants of used buffing wheels. The wheels and spacers, if any, are contiguous forming an inner cylindrical surface of the rings. Steel straps extend axially along this inner surface, the straps being secured by metal inert-gas welding to the rings at the ends of the stack. The pressure between the buffing wheels and any spacers of the stacks is so high as to suppress any tendency of the wheels or spacers to slip circumferentially with respect to each other when the stack is under high tangential force in use. The straps serve to be engaged by the keys of a drive shaft to drive the buffing apparatus.

25 Claims, 5 Drawing Sheets

Fig. 6
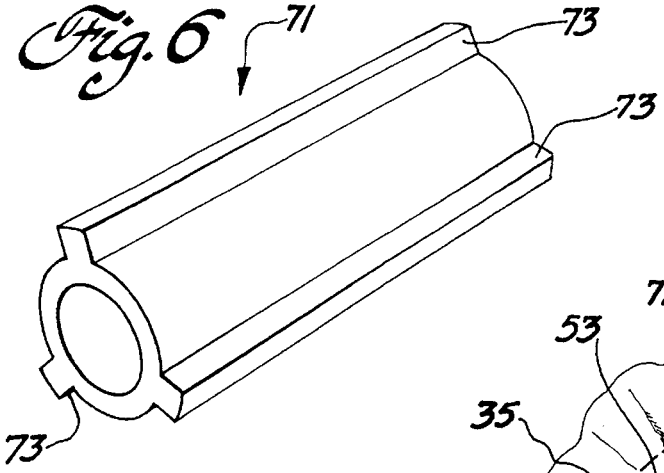
Fig. 7
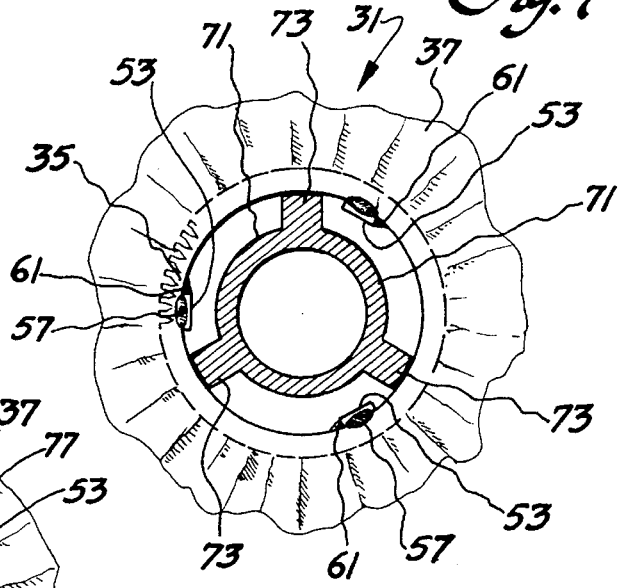
Fig. 8
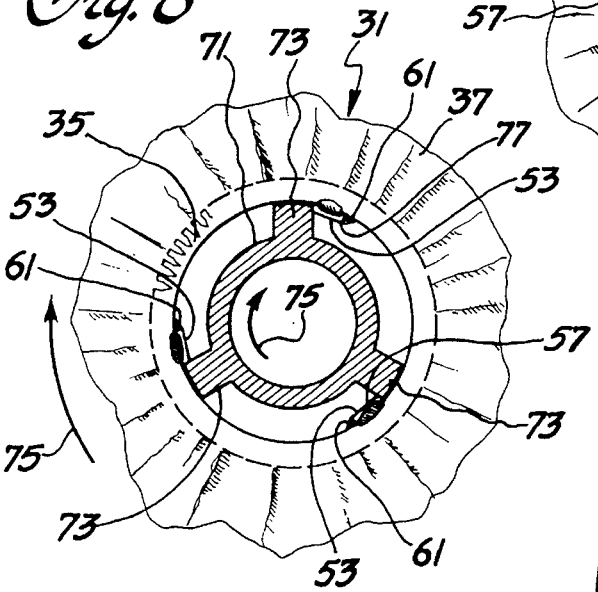
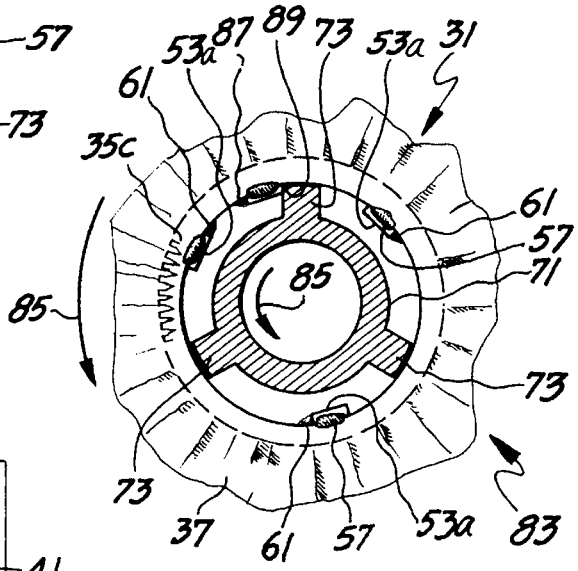
Fig. 9
Fig. 5
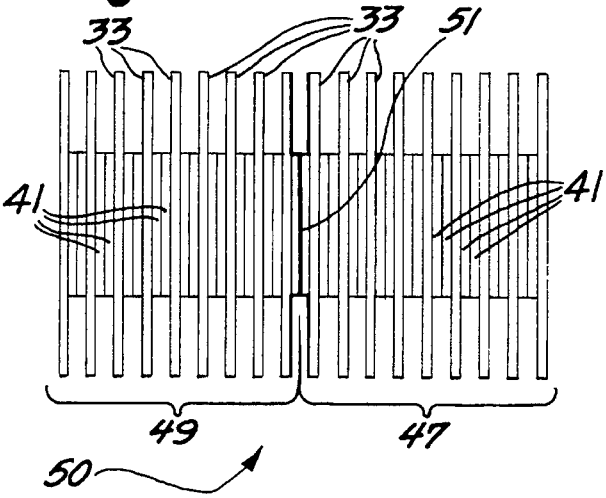

131
127
133
125
129
129
129
33
37
35
115
113
123
119
121
119
123
123
121
53
101
119
53
41d
35
43
117
113
105
103
109
107
111

129
129
133
125
127
129

127
133
125
129
129
129

121
119
117
119
121
121
119

123
119
119
119
117

BUFFING

BACKGROUND OF THE INVENTION

This invention relates to the buffing or finishing art. The words "buffing" and "finishing" are used through-out this application in their general sense including operations in which material is removed from the work and operations in which no material is removed from the work which is referred to specifically as coloring or polishing.

This invention has particular relationship to buffing apparatus in which a plurality of buffing wheels of the type shown in Schaffner U.S. Pat. No. 2,805,530, except that they are centerless, are ganged or stacked. U.S. Pat. Nos. 3,365,742 (herein '742) to J. R. Schaffner and 4,882,880 (herein '880) to Paul E. Schaffner et al. are typical of the prior art. While apparatus embodying the invention of these patents has proven itself to be highly satsifactory, this apparatus has undesirable features both from an economic and a functional aspect. In buffing apparatus of Schaffner '742, each individual wheel includes a hub 23 in which there are slots 31 and 33. Tabs 21 extend from these slots of each wheel and are locked in the slots of adjacent wheels to form a rigid unit of ganged buffing wheels. The buffing apparatus is driven through the hub. The parts, including the slotted hubs and the tabs, impose substantial cost in manufacture and maintenance of the apparatus disclosed in patent '742. The buffing apparatus of Schaffner '880 is composed of abutted, low-weight cartridges 15 (FIG. 2), each cartridge composed of a stack of buffing wheels. Each cartridge has an internal sleeve of cardboard in which there are keyways 23 of wood through which the apparatus is driven. The sleeve and keyways constitute a significant item of manufacturing cost and maintenance. In addition, the cartridges are formed by stacking buffing wheels with beads of slow-setting adhesive between the wheels and fast-setting adhesive near an end. This is a high-cost feature.

It is an object of this invention to eliminate the above-described drawbacks and deficiencies of the prior art buffing apparatus including ganged or stacked buffing wheels and to provide such apparatus which shall not include or require components such as the slotted hubs or discs of Schaffner '742 or the cardboard sleeves and wood keyways and the cement of Schaffner '880. It is also an object of this invention to provide a method of making such apparatus.

SUMMARY OF THE INVENTION

In accordance with this invention, there is provided buffing apparatus including a compressed stack of buffing wheels. Each buffing wheel is centerless including a metallic clinch ring, typically of steel, to which are secured layers of buffing fabric which extend in an annulus radially from the ring. Typically, the annular fabric has a thickness of about ¾-inch when not compressed. Spacers may be interposed between certain pairs in the compressed stack. Or there may be spacers at the ends of the stack. In the preferred practice of this invention, the spacers are recycled buffing wheels which have been worn out in use. Such spacers include a clinch ring securing an annulus of small width of the fabric. Such recycled spacers have the advantage that the inner surface of the buffing apparatus is formed at the center of a stack of the metallic clinch rings, all of which lend themselves to welding or other metallic processes.

The compressed stack is held together as a rigid unit by metallic straps, typically of steel, extending axially along the inner surface of the stack. Typically, there are three straps spaced by 120°. The pressure between buffing wheels is typically such that the thickness of the fabric annulus of each buffing wheel is reduced from ¾-inch to ½-inch. Under this pressure, the tendency of the buffing wheels to slip with respect to each other under the tangential stress applied during use is suppressed. As an additional precaution against slippage, the straps may be joined to certain or all of the rings of the individual buffing wheels or spacers. An important discovery contributing to this invention was that, with adequate pressure between the buffing wheels, adhesive as taught by Schaffner '880 can be dispensed with.

The straps serve a double purpose. In addition to maintaining the stack as a rigid unit, they serve to drive the stack during a buffing operation, thus solving the problem of driving a stack formed of centerless buffing wheels. The straps are engaged by the keys of a mandrel or drive shaft and rotate the stack of buffing wheels. Where the buffing apparatus is to rotate in one direction, straps spaced by 120° are adequate. Where imbalance may be tolerated, the buffing apparatus may be driven by only one key in engagement with one strap. Where the buffing apparatus is driven in either direction, a pair or pairs of straps are provided at one or each strap position to engage the key or keys, one of the pair to drive the apparatus in one direction and the other to drive the apparatus in the opposite direction. Where a strap is joined to individual rings along the stack, the joints should be along the edges of the strap opposite to the edges to be engaged by the key or keys. The expression "strap means" in the claims means one strap or a plurality of straps, for example, three spaced 120°, extending axially along the rings.

In the practice of this invention, the buffing apparatus is produced with a fixture including a tube which serves as a guide for stacking the buffing wheels. The buffing wheels are a slip-fit over the tube, the diameter of the clinch ring of each wheel being a few thousands of an inch greater than the external diameter of the tube. The fixture includes a pressure cylinder having a piston rod centered along the tube.

In the practice of this invention, the lowermost buffing wheel or spacer is mounted on the tube and joined to the straps which extend in slots along the tube. The buffing wheels and/or spacers are then stacked on the lower-most element to a height above the tube, typically of 25% of the length of the tube. Downward pressure is applied to the stack by the piston rod, compressing the stack so that the top buffing wheel or spacer is at level of the top of the tube. Witch the stack under pressure, the straps are joined to the ring of the upper element forming the pressurized stack into a rigid ganged buffing apparatus. The straps are preferably joined to the clinch rings by metal inert-gas (MIG) welding to minimize the heat developed at the welds which might damage the rings and scorch the fabric.

BRIEF DESCRIPTION OF THE DRAWINGS

For a better understanding of this invention, both as to its organization and as to its method of operation, together with additional objects and advantages thereof, reference is made to the following description, taken in connection with the accompanying drawings, in which:

FIG. 5 is a diagrammatic view in side elevation showing buffing apparatus formed of a plurality of ganged buffing assemblies;

FIG. 6 is a fragmental view in perspective showing the shaft or mandrel through which the buffing apparatus shown in FIG. 1 is driven in the use of the apparatus according to this invention;

FIG. 7 is a fragmental view in end elevation showing the relationship at the start of a buffing operation between the shaft shown in FIG. 6 and the straps of buffing apparatus shown in FIG. 1 which is to be driven in only one direction the shaft being shown in transverse section;

FIG. 8 is a fragmental view in end elevation similar to FIG. 7 with the keys of the shaft in driving relationship with the straps;

FIG. 9 is a fragmental view in end elevation showing the relationship between the keys of the shaft shown in FIG. 6 and the straps shown in transverse suction of apparatus shown in FIG. 1 which is driven in both directions, the shaft being shown in transverse section in counterclockwise-driving relationship with the straps;

DESCRIPTION OF EMBODIMENT

Figure 2:
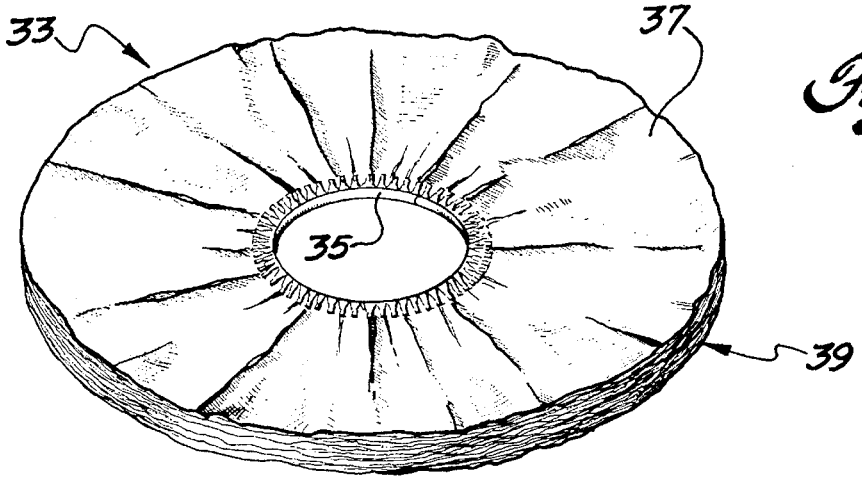
FIG. 2 is a view in perspective of a buffing wheel of the apparatus shown in FIG. 1.
Figure 3:
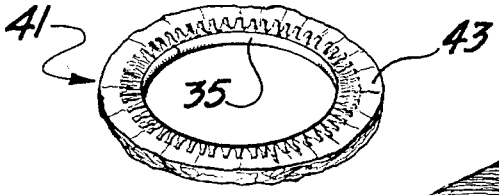
FIG. 3 is a view in perspective of a recycled spacer which is part of the apparatus shown in FIG. 1.
Figure 1:
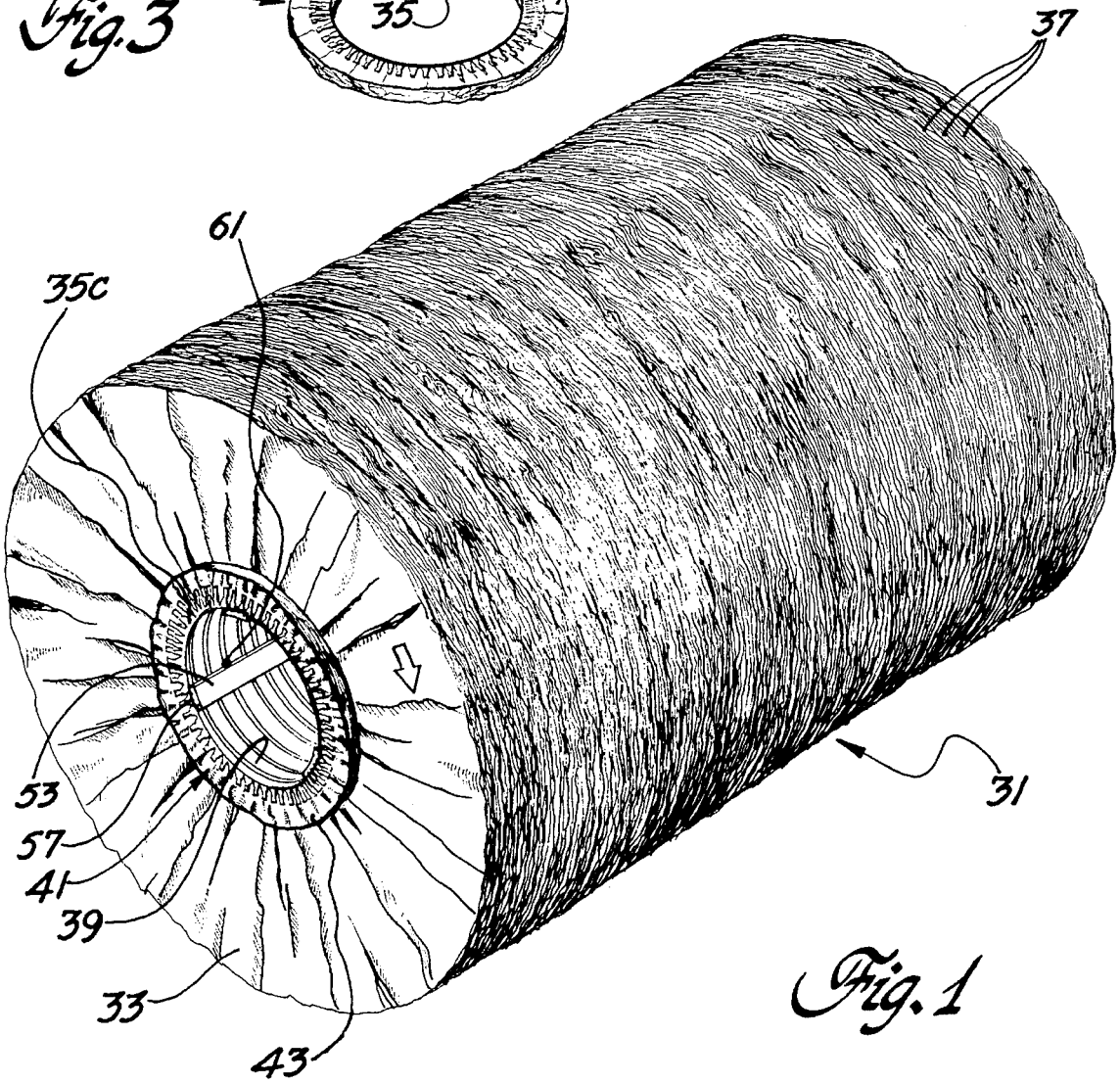
FIG. 1 is a view in perspective of ganged or stacked buffing apparatus in accordance with this invention.

The apparatus shown in FIGS. 1 through 9 is buffing apparatus 31 formed of ganged or stacked buffing wheels 33. Each buffing wheel 33 (FIG. 2) includes a metallic clinch ring 35 typically of steel, securing layers 37 of fabric which extend radially from the ring in an annulus 39.

The buffing apparatus 31 may be formed only of buffing wheels 33. Or it may be formed of buffing wheels 33 combined with spacers 41. Preferably, a spacer 41 (FIG. 3) may be a recycled buffing wheel, i.e., a buffing wheel which has been worn out in use. Typically, a spacer 41 includes the clinch ring 35 securing the remnant 43 of the fabric which was held by the clinch ring. The remnant ring 43 is in the form of an annulus. If desired, the remnant may be ground down to form the annulus. The buffing apparatus may include abutting buffing wheels 33 having spacers 41 at one or both ends. Or a spacer 41 may be interposed between each pair of buffing wheels 33. Or as in the buffing assembly 45 shown in FIG. 5, spacers 41 can be provided on each face of each buffing wheel 33 so that two spacers 41 are interposed between each pair of buffing wheels 33. As shown in FIG. 5, stacked buffing assemblies 47 and 49 are abutted to form buffing apparatus 50. At the joint 51 between the assemblies 47 and 49, there are two abutting spacers 41, one abutting the buffing wheel 33 of assembly 47 on the right and the other abutting the buffing wheel of the assembly 49 on the left.

Figure 18:
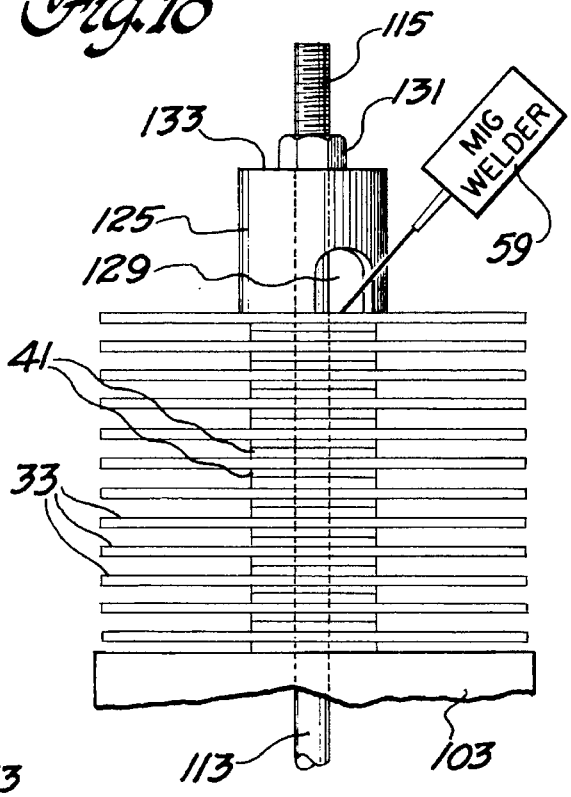
FIG. 18 is a fragmental diagrammatic view in side elevation similar to FIG. 17 but showing the welding operation following the compression.

The stack of buffing wheels 33 of the buffing apparatus 31 is formed into a rigid unit by straps 53 of metal, typically steel. Typically, there are three straps spaced 120°. The straps are joined to the end of clinch rings, each either a buffing wheel 33 or a spacer 41, by welds 55 (FIG. 15) and 57 (FIG. 4), preferably produced by a metal inert-gas welder 59 (FIG. 18). Weld 55 is produced to the lowermost buffing wheel 33or spacer 41 at the start of the assembly of the stack 31. Weld 57 is produced after the buffing wheels are stacked and are under high pressure. The pressure is sufficient and the welds are strong enough to resist slippage of the buffing wheels or spacer relative to the adjacent elements under the high tangential force produced in the use of the buffing apparatus when it is subjected to a high tangential load. To further strengthen the connection between the straps 53 and the stack, side welds 61 (FIG. 4) may be produced between clinch rings 35c along the stack 31 and the straps 53. The welds 61 should be small spot welds to preclude any damage to the rings and to the fabric 37 which they hold. The top weld 51 and the bottom weld 55 should be flush with or below the top and bottom fabric.

The straps 53 serve a double purpose. In addition to holding the stack 31 together as a rigid unit, they serve to drive the buffing apparatus, thus eliminating the hub 23 of Schaffner '742 and the sleeve and keyways of Schaffner '880. The buffing apparatus 31 is driven by a shaft or mandrel 71 having keys 73. The buffing apparatus is mounted on the shaft 71 with the keys 73 in driving relationship with the straps 53 as shown in FIG. 8 and FIGS. 7 and 8 show buffing apparatus 31 which is driven in only one direction, clockwise, as indicated by the arrow 75. In this case, the side welds 61 are along the edges 77 (FIG. 4) of the straps 53 which are opposite to the edges 79 engaged by the keys 73. If the buffing apparatus is to be driven in both directions, additional straps are included in the buffing apparatus 83 shown in FIG. 9. The additional strap 81 or other additional straps is or are mounted between the straps **53*a* so that the keys of the shaft can engage one set of straps 53*a* to rotate the buffing apparatus 83 clockwise or the additional strap, or straps 81, to rotate the buffing apparatus counterclockwise as indicated by the arrow 85. In this case, the side welds 87 should be along the edge of strap 81 opposite to the edge 89 which is engaged by the key 73**.

The apparatus for making the buffing apparatus 31 in the practice of this invention and its operation are shown in FIGS. 10 through 19.

This apparatus comprises a fixture 101 (FIGS. 10–14) including a table or platform 103 having a generally central opening 105. Under the platform 101, there is a cylinder 107 having a piston (not shown), an inlet 109 for conducting fluid to drive the piston downwardly and an inlet 111 for driving the piston upwardly. The piston (not shown) drives a piston rod 113 downwardly or upwardly. The piston rod 113 carries a thread 115 at the top.

The fixture 101 also includes a tube 117. The external diameter of this tube 117 is dimensioned to receive a buffing wheel 33 or a spacer 41 in a slip-fit with the clinch ring 35 of the buffing wheel or spacer spaced only a few thousands of an inch from the tube. The tube 117 is positioned about opening 105, generally coaxially with the piston rod 113. The tube 117 has long slots 119 spaced by 120° and shorter slots 121 spaced 120° in its outer periphery. The short slots 121 are interposed uniformly between long slots 119. There are also short straps 123 dimensioned to be seated in the short slots 121.

The fixtures also includes a cup or hood 125. The cup 125 has a center opening 127 which is a slip-fit with respect to the piston rod 105. There are also slots or portals 129 extending inwardly from the rim of the cup.

Figure 19:
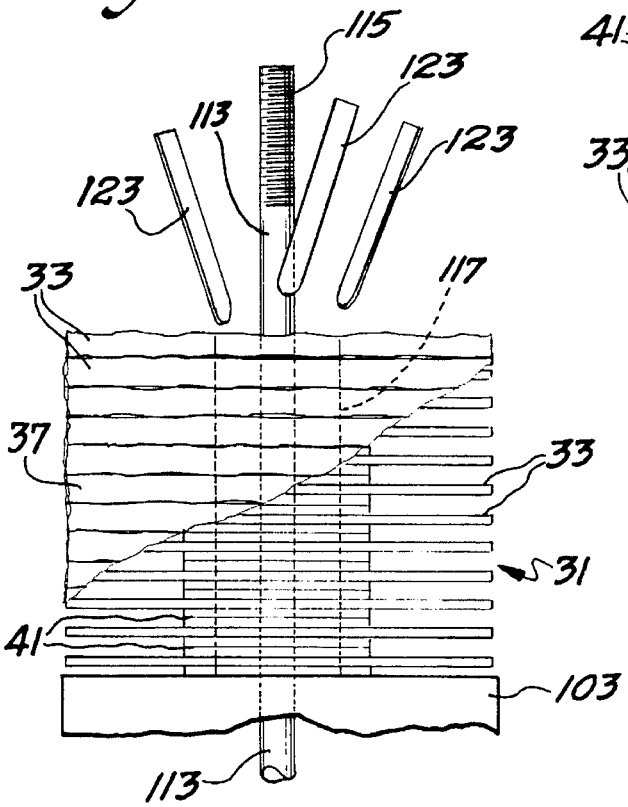
FIG. 19 is a diagrammatic view in side elevation with part broken away showing the completion of the construction of stacked buffing apparatus in accordance with this invention.
Figure 4:
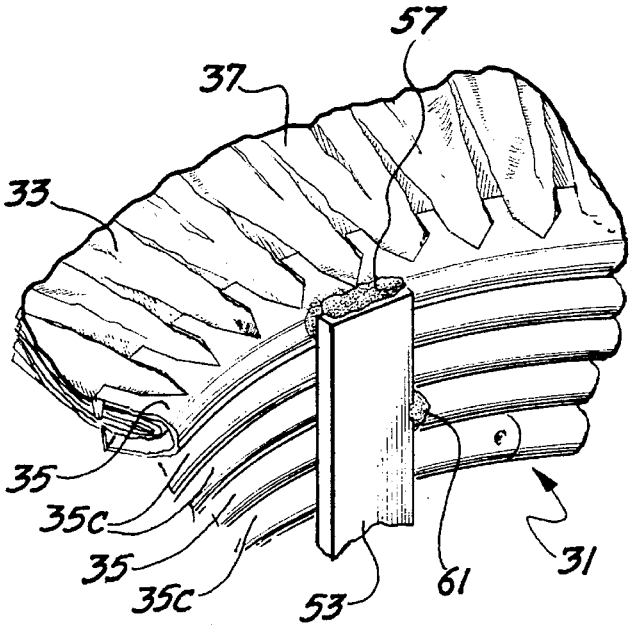
FIG. 4 is a fragmental view in perspective enlarged of a part of the apparatus shown in FIG. 1 showing the features of this apparatus.
Figure 10:
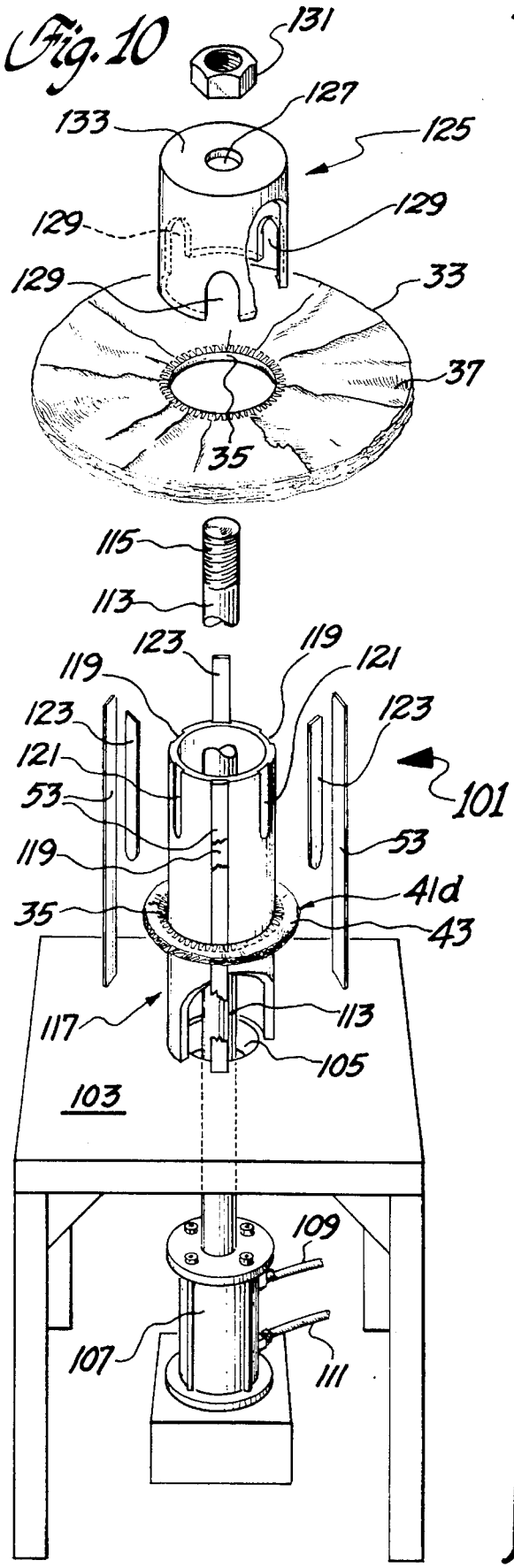
FIG. 10 is an exploded view in perspective showing a fixture for producing buffing apparatus in accordance with this invention, in the practice of the method of this invention.
Figure 11:
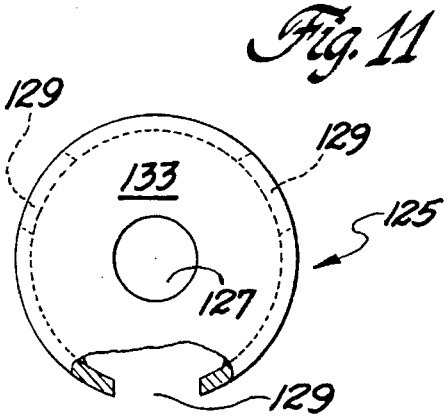
FIG. 11 is a plan view, partly in section, of the cup of the fixture shown in FIG. 10, for compressing the stack of buffing wheels in producing a compressed stack of buffing wheels in the practice of this invention.
Figure 12:
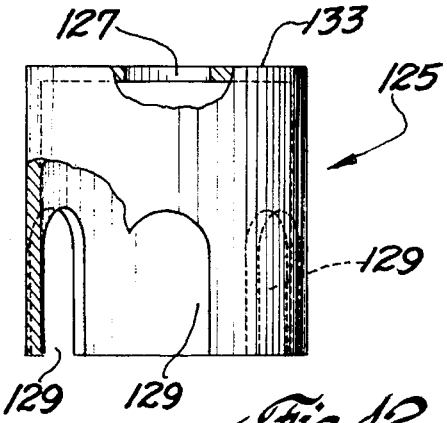
FIG. 12 is a view in side elevation and partly in section of this cup.
Figure 13:
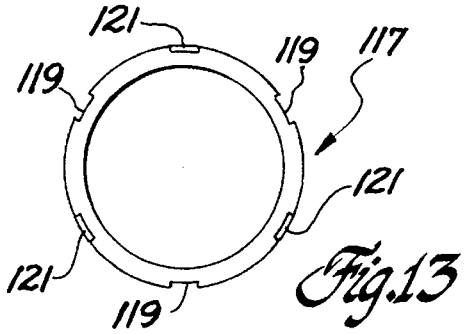
FIG. 13 is a plan view of the tube of the fixture shown in FIG. 10 on which the buffing wheels are stacked in the practice of this invention.
Figure 14:
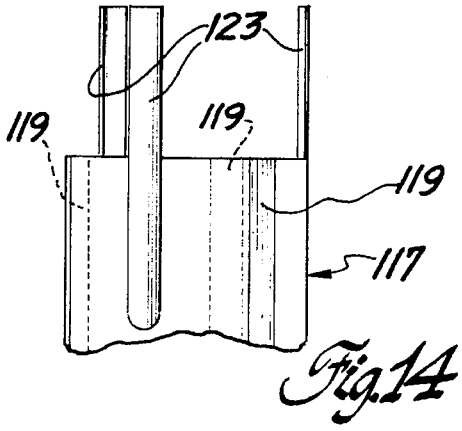
FIG. 14 is a fragmental view in side elevation of this tube with removable straps for supporting buffing wheels or spacers which are above the tube at the start of the compression in place.
Figure 15:
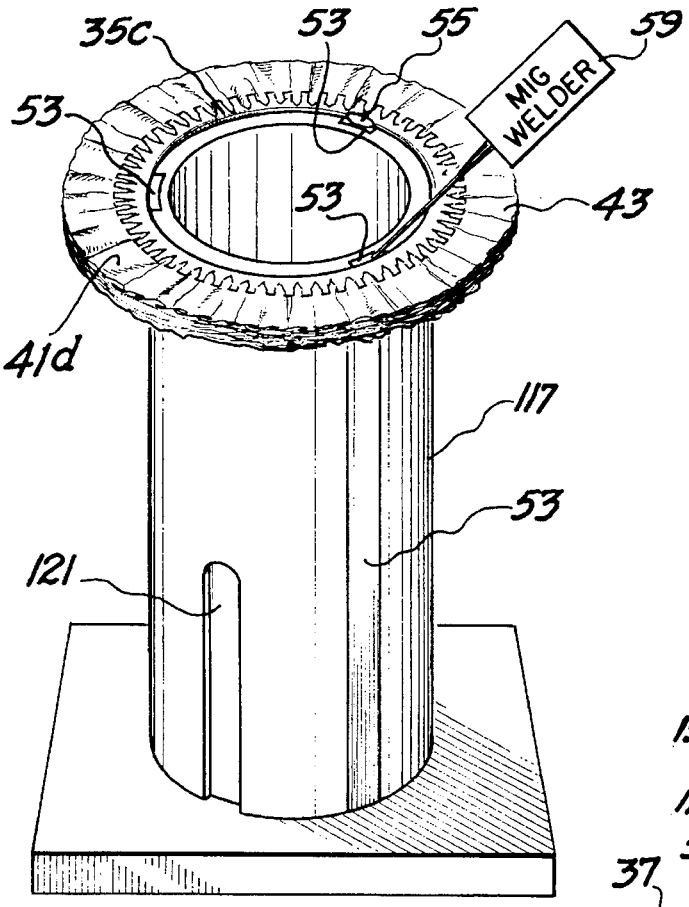
FIG. 15 is a diagrammatic view in perspective showing how the straps are welded to the ring of the lowermost wheel or spacer.
Figure 16:
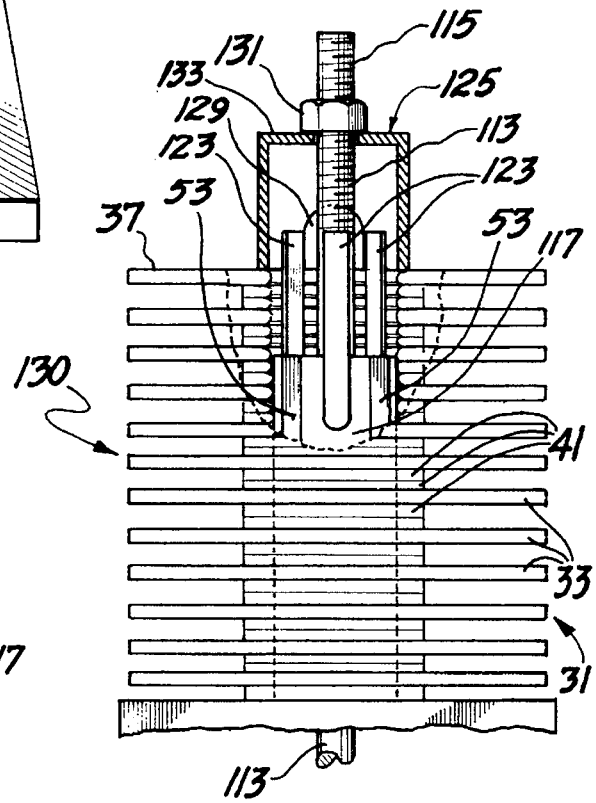
FIG. 16 is a fragmental diagrammatic view in side elevation and partly in section showing the relationship of the cup and the stack of buffing wheels and spacers at the start of a compressing operation.
Figure 17:
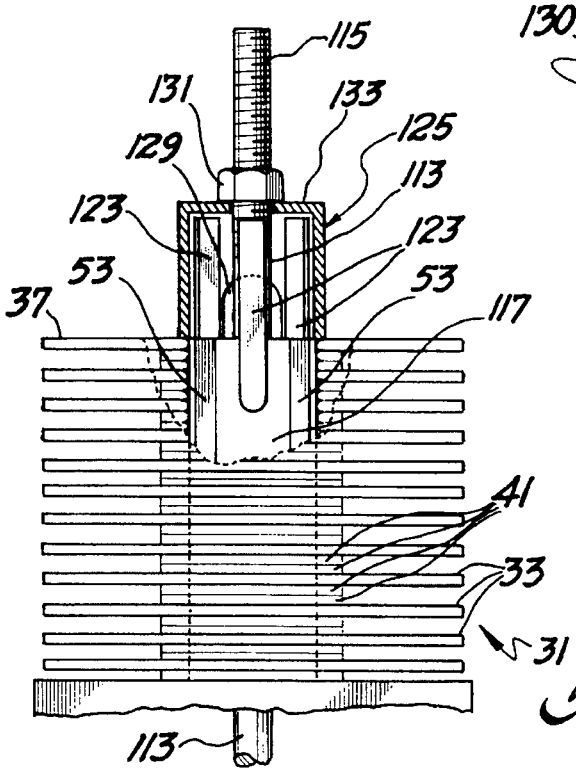
FIG. 17 is a fragmental diagrammatic view in side elevation and partly in section similar to FIG. 16 but showing the relationship of the cup and stack at the end of a compressing operation.

In the practice of this invention, the long straps 53 are seated in the long slots 119 of tube 117. A buffing wheel or a spacer 41*d* (spacer shown) is then mounted on the tube 117 and positioned near its lower end with the clinch ring 35 in contact with the straps 53. The tube 117, with the buffing wheel or spacer 41*d* positioned on it, is then turned upside down and welds are produced between ring 35*c* of the buffing wheel or spacer and the straps 53 near the lower ends (FIG. 15). Next, the tube 117, with the element 41*d* on it, is returned to the upright position. The straps 123 are seated in the slots 121. The dimensioning of the straps 123 and the slots 121 is such that the straps 123 extend above the upper rim of the tube 117 (FIG. 16). The buffing wheels and the spacers 41, as the case may be, are then stacked on the tube 117 and about the straps 123 above the upper rim of tube 117. Typically, the elements 31 or 41 are stacked to a height of about 25% of the length of the tube 117 above the upper rim of the tube. The cup 125 is then mounted over the tube 117 with its rim resting on the clinch ring of the uppermost element 33 or 41. The piston rod 113 passes through the hole 127 with the thread protruding. The fixture and the components mounted in it, in an uncompressed stack 130 as just described, is shown in FIG. 16. A nut 131 is threaded on thread 115 (FIG. 16) of the rod 113. The nut 131 extends over the top 133 of cup 125. The cylinder 107 (FIG. 10) is now actuated to pull the piston rod 113 and nut 131 downwardly. The cup 125 compresses the stack downwardly so that the top of the stack is at the level of the upper rim of tube 117 as shown in FIG. 17. Through the portals 129, the straps 53 are welded near or at their upper ends to the clinch ring of the upper element 33 or 41 as shown in FIG. 18. The stack is now a rigid annulus. The straps 123 are removed as shown in FIG. 19. The stack may be removed and welds 61 produced between the straps 53 and adjacent rings 35 as thought necessary.

Typically, the pressure produced by cylinder 107 (FIG. 10) is 150 pounds per square inch. In a typical case, the buffing apparatus 31 (FIG. 1) would be formed of buffing wheels 33 (FIG. 2) in which the clinch ring 35 has an inner diameter of seven inches and an overall diameter including the fabric of 24 inches. The buffing fabric 37 before compression has a thickness of ¾-inch. The clinch ring 35 has a diameter or thickness of ⅝inch. The lower rim of cup 125 (FIG. 10) engages the ring 35. The radius to the center of the clinch ring is $3\frac{8}{16}+\frac{5}{16}=3\ \frac{13}{16}$. The area over which the pressure is applied to a stack of buffing wheels 33 is $$5/8 \times 313/16 \times 2\pi = \frac{5 \times 16 \times \pi}{64} = 15 \text{ square inches.}$$

The total force applied to the rings is 2250 pounds. The fabric 37 of each buffing wheel 33 in the stack is compressed to ½-inch.

While preferred embodiments of this invention and preferred practice of the method of this invention have been disclosed herein, many modifications thereof are feasible. This invitation is not to be restricted except insofar as necessitated by prior art.

I claim:

1. A buffing assembly including a stack of a plurality of separate buffing wheels with or without spacers, each wheel including a central clinch ring to which is secured buffing fabric extending radially from said clinch ring, each spacer including a ring, said buffing wheels and spacers, if any, being mounted in said stack with said rings arrayed contiguously under substantial pressure, and strap means extending generally axially along said rings secured to the outermost rings of the stack to maintain said stack as a rigid unit with the rings under pressure, the pressure being of a magnitude sufficient to suppress circumferential rotation of individuals of said wheels or spacers, if any, relative to each other when the fabric of said wheels are under tangential force when the buffing assembly is carrying out a buffing operation.

2. The buffing assembly of claim 1 wherein the rings and the strap means are composed of metal and the strap means is secured to the outermost rings of the stack by welds between the end of the strap means and the rings.

3. The buffing assembly of claim 2 wherein the welds are arc welds produced by metal inert-gas welding to minimize the damage to the rings and fabric of the buffing wheels to whose rings the strap means are joined.

4. The buffing assembly of claim 2 wherein the strap means is joined to at-least-one intermediate buffing wheel and/or spacer by a spot weld between the ring of said at-least-one intermediate wheel and/or spacer and the strap means.

5. The buffing assembly of claim 4 wherein the spot weld is produced by metal inert-gas welding to minimize the damage to the ring and/or spacer and and fabric of the intermediate wheel.

6. Apparatus for buffing work including the buffing assembly of claim 1 and a shaft having key means, said shaft being mounted in driving relationship with said assembly with said key means adapted to be positioned in buffing assembly-driving engagement with the strap means through contact of the key means with an edge of the strap means, to drive said buffing assembly to buff said work.

7. The buffing assembly of claim 4 wherein the spot weld is between strap means along an edge thereof and the ring of the intermediate buffing wheel and or spacer.

8. Apparatus for buffing work including a buffing assembly according to claim 7 and a shaft having key means, said shaft being mounted in driving relationship with said assembly with said key means adapted to be positioned in buffing assembly-driving engagement with the strap means through contact of the key means with the edge of the strap means opposite to the edge where the spot weld is formed.

9. The buffing assembly of claim 1 wherein spacers are interposed between each buffing wheel in the stack and the adjacent buffing wheel.

10. The buffing assembly of claim 1 including a spacer at at-least-one end thereof, said spacer including a recycled buffing wheel which has been worn out in use.

11. Apparatus for buffing work including a stack of buffing wheels with or without spacers, each wheel including a clinch ring clamping buffing fabric extending radially from said clinch ring and each said spacer including a ring, said buffing wheels being stacked with said rings contiguously as a hub for said stack, said stack also including strap means extending generally axially along the inner periphery of said stack constituting said hub, secured to certain of said rings to form said stack into a rigid unit; said apparatus also including a shaft mounted in driving relationship with said rigid unit and having key means adapted to be positioned in a stack-driving relationship with said strap means through contact of said key means with an edge of said strap means.

12. The method of producing a buffing assembly with a plurality of buffing wheels with or without spacers, each buffing wheel including a clinch ring to which is secured fabric layers extending radially therefrom and each spacer including a ring; the said method comprising: forming a stack of said buffing wheels with or without spacers with said rings contiguous as a hub of said stack and the fabric layers, disposing strap means generally axially along the rings defining the internal periphery of said stack, securing said strap means to the ring at one end of said stack, impressing a compressive force on said stack, while said stack is under compression by said compressive force, securing said strap means to the ring at the other end of said stack to form said stack into a rigid stack and removing the compressive force; the strap means forming said stack into a compressed rigid buffing assembly.

13. The method of producing buffing apparatus with a plurality of buffing wheels with or without spacers, each buffing wheel including a clinch ring to which is secured buffing fabric extending radially therefrom and each spacer including a ring; the said method comprising: mounting a lowermost wheel or spacer, if any, on a tube, extending strap means generally axially along the external surface of said tube, securing said strap means near its one end to the ring of said lowermost buffing wheel or spacer, stacking the other buffing wheels with or without spacers of said plurality on said tube to form a stack of said buffing wheels with or without spacers, compressing said buffing wheels and spacers, if any, with said buffing wheels and spacers, if any, compressed securing the strap means near its other end to the ring of the uppermost buffing wheel or spacer in the stack thus forming a rigid buffing assembly, and removing said assembly from said tube.

14. A buffing assembly including a stack of buffing wheels with or without spacers, each wheel including a clinch ring clamping buffing fabric extending radially from said clinch ring, and each spacer including a ring, said buffing wheels being stacked with said rings as a hub for the stack, said stack also including strap means extending generally axially along said rings at the inner periphery of said stack, said strap being connected to said rings to form said stack into a rigid unit.

15. The method of producing a buffing assembly with a plurality of buffing wheels with or without spacers, each buffing wheel including a clinch ring to which is secured fabric layers extending radially therefrom and each spacer including a ring; the said method comprising: forming a stack of said buffing wheels with or without spacers with said rings contiguous as a hub of said stack and the fabric layers, disposing strap means generally axially along the rings defining the internal periphery of said stack, impressing a compressive force on said stack, and forming said stack into a rigid buffing assembly by connecting said strap means to said rings.

16. A buffing assembly including a stack of a plurality of separate buffing wheels with or without spacers, each wheel including a central clinch ring to which is secured buffing fabric extending radially from said clinch ring, each spacer including a ring, said buffing wheels and spacers, if any, being mounted in said stack with said rings arrayed contiguously under substantial pressure, and strap means extending generally axially along said rings secured at least to the outermost rings of the stack to maintain said stack as a rigid unit with the rings under pressure, said strap means including a pair of cooperative sets of straps, one set of the pair being positioned for driving said assembly in one direction and the other set of the pair being positioned for driving said assembly in the opposite direction, the pressure being of a magnitude sufficient to suppress circumferential rotation of individuals of said wheels or spacers, if any, relative to each other when the fabric of said wheels are under tangential force when the buffing assembly is carrying out a buffing operation.

17. Apparatus for buffing work including the buffing assembly of claim 16 and a shaft having key means, said shaft being mounted in driving relationship with said assembly with said key means adapted to be positioned in buffing-assembly driving engagement with the straps of one of the sets of straps to drive said buffing assembly in one direction and in buffing-assembly driving engagement with the straps of the other of said sets to drive said buffing assembly in the opposite direction.

18. A buffing assembly including a stack of a plurality of separate buffing wheels with or without spacers, each wheel including a central clinch ring to which is secured buffing fabric extending radially from said clinch ring, each spacer including a ring, said buffing wheels and spacers, if any, being mounted in said stack with said rings arrayed contiguously under substantial pressure, and strap means extending generally axially along said rings secured at least to the outermost rings of the stack to maintain said stack as a rigid unit with the rings under pressure, said strap means including at least one pair of straps, one strap of the pair being adapted to drive said assembly in one direction and the other strap of the pair being adapted to drive said assembly in the opposite direction, the pressure being of a magnitude sufficient to suppress circumferential rotation of individuals of said wheels or spacers, if any, relative to each other when the fabric of said wheels are under tangential force when the buffing assembly is carrying out a buffing operation.

19. Apparatus for buffing work including a stack of buffing wheels with or without spacers, each wheel including a clinch ring clamping buffing fabric extending radially from said clinch ring and each said spacer including a ring, said buffing wheels being stacked with said rings contiguously as a hub for said stack, said stack also including strap means extending generally axially along the inner periphery of said stack, secured to certain of said rings to form said stack into a rigid unit; said apparatus also including a shaft mounted in driving relationship with said stack and having key means adapted to be positioned in a stack-driving relationship with said strap means, said strap means including a pair of sets of straps with said shaft being mounted with its key means disposed to engage between the straps of the pair to engage one strap of the pair to drive the stack in one direction and to engage the other strap of the pair to drive said stack in the opposite direction.

20. The method of producing a buffing assembly with a plurality of buffing wheels with or without spacers, each buffing wheel including a clinch ring to which is secured fabric layers extending radially therefrom and each spacer including a ring; the said method comprising: forming a stack of said buffing wheels with or without spacers with said rings contiguous as a hub of said stack and the fabric layers, disposing strap means generally axially along the rings defining the internal periphery of said stack, securing said strap means to the ring at one end of said stack, impressing a compressive force on said stack, while said stack is under compression by said compressive force, securing said strap means to the ring at the other end of said stack, and removing the compressive force; the strap means forming said stack into compressed rigid buffing apparatus, said strap means being secured to said rings by metal inert-gas welding.

21. The method of producing a buffing assembly with a plurality of buffing wheels with at least one annular spacer having a ring at at-least one end of said stack, each buffing wheel including a clinch ring to which is secured fabric layers extending radially therefrom; said method comprising: forming a stack of said buffing wheels with said at-least one spacer at at-least one end thereof, and with said rings contiguous as a hub of said stack and the fabric layers, disposing strap means generally axially along the rings defining the internal periphery of said stack, securing said strap means to the ring at one end of said stack, impressing a compressive force on said stack, while said stack is under compression by said compressive force, securing said strap means to the ring at the other end of said stack, and removing said compressive force, the secured strap means forming said stack into a compressed rigid buffing assembly, said strap means being secured to the ring of said spacer at-least one end of said stack.

22. The buffing assembly of claim 21 wherein the spacers are recycled buffing wheels which have been worn out in use, each spacer including a clinch ring.

23. The method of producing buffing apparatus with a plurality of buffing wheels with or without spacers, each buffing wheel including a clinch ring to which is secured buffing fabric extending radially therefrom and each spacer including a ring; the said method comprising: mounting a lowermost wheel or spacer, if any, on a tube, extending strap means generally axially along the external surface of said tube, securing said strap means near its one end to the ring of said lowermost buffing wheel or spacer, stacking the other buffing wheels with or without spacers of said plurality on said tube to form a stack of said buffing wheels with or without spacers, compressing said buffing wheels and spacers, if any, with said buffing wheels and spacers, if any, compressed, securing the strap means near its other end to the ring of the uppermost buffing wheel or spacer in the stack thus forming rigid buffing apparatus, and removing said apparatus from said tube, the strap means being secured near its end to said rings by metal inert-gas welding.

24. The method of producing buffing apparatus with a plurality of buffing wheels with or without spacers, each buffing wheel including a clinch ring to which is secured buffing fabric extending radially therefrom and each spacer including a ring; the said method comprising: mounting a lowermost wheel or spacer, if any, on a tube, extending strap means generally axially along the external surface of said tube, securing said strap means near its one end to the ring of said lowermost buffing wheel or spacer, stacking the other buffing wheels with or without spacers of said plurality on said tube to form a stack of said buffing wheels with or without spacers, the buffing wheels with or without spacers being stacked to a height substantially above the end of the tube, compressing said buffing wheels and spacers, if any, the stack being compressed substantially to the level of the end of the tube, with said buffing wheels and spacers, if any, so compressed securing the strap means near its other end to the ring of the uppermost buffing wheel or spacer in the stack thus forming rigid buffing apparatus, and removing said apparatus from said tube.

25. The method of claim 24 wherein prior to the compression step, the stack is about 25% higher than the tube.

* * * * *